United States Patent [19]

Schwalbe

[11] 4,088,228

[45] May 9, 1978

[54] CLOTHES STAND

[76] Inventor: Ingemar Schwalbe, 9 St. Eriksgatan, Stockholm, Sweden, S-112 39

[21] Appl. No.: 643,605

[22] Filed: Dec. 22, 1975

[51] Int. Cl.[2] ..... E05B 73/00

[52] U.S. Cl. ..... 211/4; 211/168

[58] Field of Search ..... 211/4, 8, 9, 96, 168, 211/169; 70/58, 60, 62

[56] References Cited

U.S. PATENT DOCUMENTS

| | | | |
|---|---|---|---|
| 724,118 | 3/1903 | Mulkerins | 211/96 |
| 1,047,366 | 12/1912 | Alston | 211/4 |
| 1,618,885 | 2/1927 | Minor | 211/8 |
| 2,162,919 | 6/1939 | McAuliffe et al. | 211/96 |
| 2,791,335 | 5/1957 | Leebow | 211/8 X |
| 2,897,608 | 8/1959 | Langendorf | 211/168 X |
| 3,014,593 | 12/1961 | Risely et al. | 211/4 |
| 3,058,599 | 10/1962 | Brylski | 211/168 |
| 3,117,674 | 1/1964 | Ligeikis et al. | 211/168 |
| 3,400,812 | 9/1968 | Snow | 211/4 X |
| 3,786,927 | 1/1974 | Manheim | 211/4 |

FOREIGN PATENT DOCUMENTS

| | | | |
|---|---|---|---|
| 1,520,752 | 3/1968 | France | 211/96 |
| 543,080 | 9/1929 | Germany | 211/4 |
| 167,865 | 7/1904 | Germany | 211/4 |
| 791,521 | 3/1958 | United Kingdom | 211/168 |

*Primary Examiner*—Roy D. Frazier
*Assistant Examiner*—Robert W. Gibson, Jr.

[57] ABSTRACT

A clothes stand for suspending clothes articles, comprising a clothes hanger, a holder for the clothes hanger, which hanger consists of an arc-bent rod in the form of a "clothes hanger", which at one end is provided with a downwardly directly rod intended to be threaded through the sleeve of an article, and the holder being so formed as to hold the hanger in upright position.

4 Claims, 8 Drawing Figures

FIG. 1
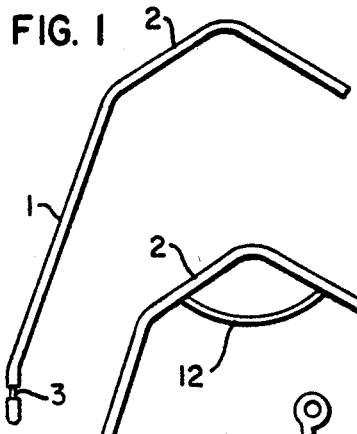
FIG. 2
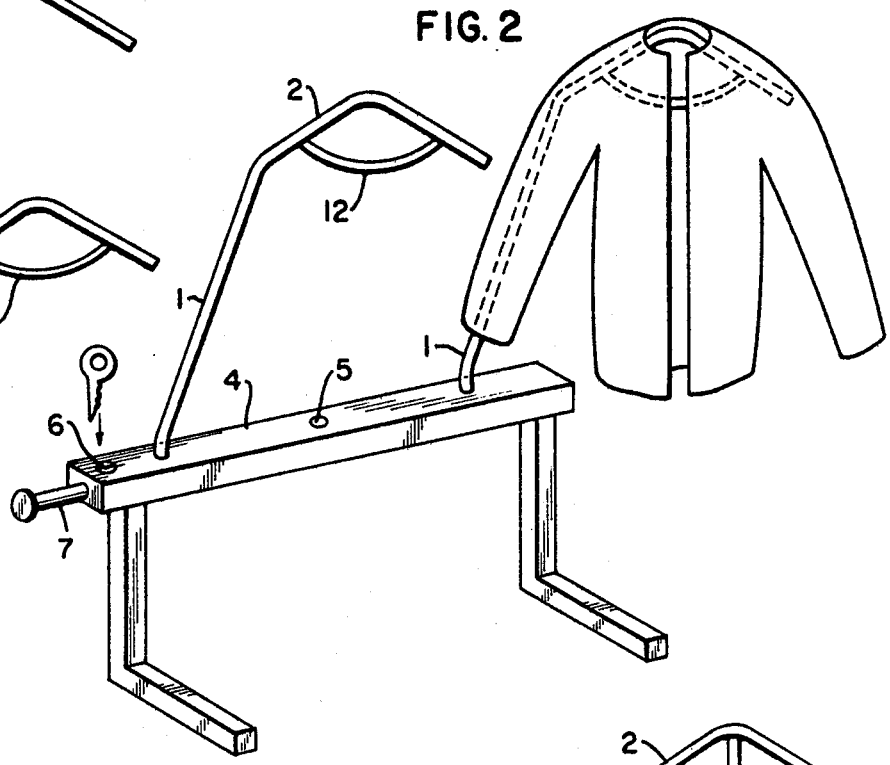
FIG. 8
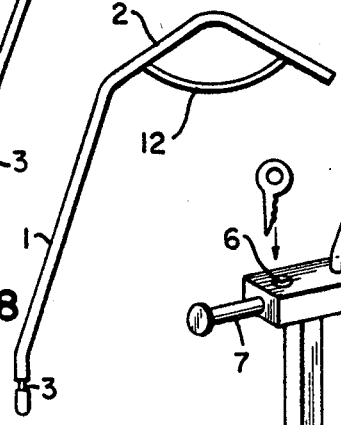
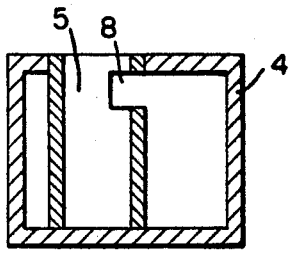
FIG. 5
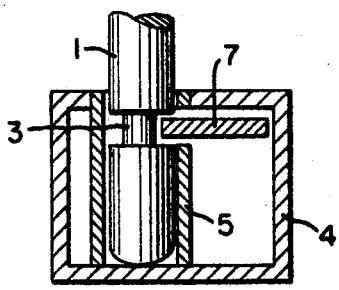
FIG. 6
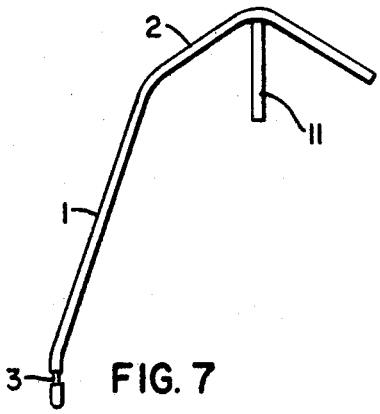
FIG. 7
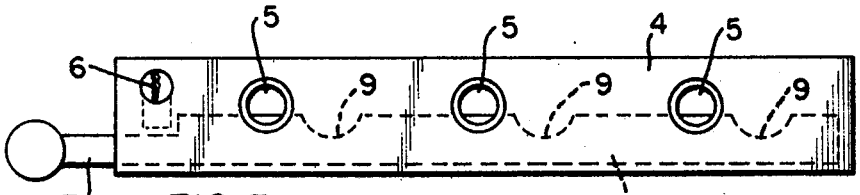
FIG. 3
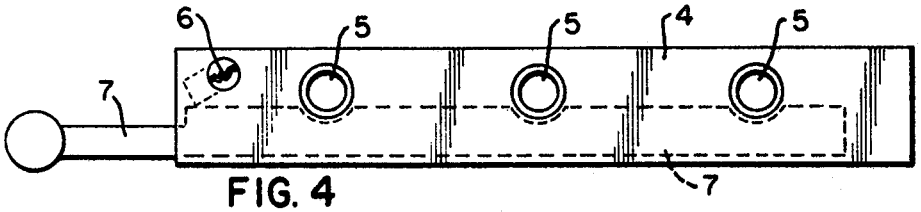
FIG. 4

CLOTHES STAND

It is often desirable to be able to lift clothing articles to an elevated position, for example in order to utilize the space upwardly beneath the top of a wardrobe or in order not to be embarrassed by washed clothes suspended in a bathroom. This desire is realized by the present invention, which besides renders the take-down of lifted-up clothing articles easy. The invention is particularly adapted for clothes worn over the shoulders, such as coats and shirts. The nature of the invention becomes apparent from the attached claims.

It may particularly be pointed out that it is easy to hold with one hand the lower portion of the downwardly directed leg of the clothes-hanger and to position it, for example, into a clothes-rail mounted in a wall, with a heavy clothing article suspended on the hanger, compared with how much of balancing capacity is required for attaching a clothing article to a high upwardly located hook or rod by means of some other kind of a clothes-hanger provided with a bar. The device according to the present invention involves the further advantage that suspended clothing articles can be arranged pivotal in horizontal direction by a rotary mounting of the hanger in the holder. It is thereby possible, like turning over the leaves in a book, to skim through suspended clothing articles or, if there is sufficient space, to swing them aside. No other device solves the problem of the combination of being pivotal and easily accessible to a highly located suspension.

In view of the aforesaid advantages, and not the least because of the possibility of easily taking an article from a hanger without even having to touch the same at the take-down, the present invention must be regarded constituting an essential improvement of the conventional possibilities to suspend clothes in an expedient manner.

The invention can be completed with two devices whereby clothes can be kept in safe custody. By providing the hanger with a projection extending from its upper portion and through such a distance that the sleeve of a suspended article cannot be threaded over the same, a suspended article cannot on this way be removed therefrom, provided that according to the above description the downwardly directed leg of the hanger extends through the sleeve of the clothing article. The only possibility of detaching the article is to lift the hanger out of the holder and pull the hanger out of the sleeve. Also this, however, can be prevented by locking the hanger with a locking means, for example a key-operated lock. A plurality of hangers then can be placed together in one clothes stand and be locked by one lock in common. Such a stand can protect suspended expensive clothes displayed in a shop. Customers may skim through the clothing articles and look at them from both sides when the hangers, in spite of the locking, are made pivotal in the holder, for example in such a manner, that the hanges downwardly are provided with peripheral recesses, with which a latch-bolt common to all holders can engage. A shop-assistant having the key to the lock can then unlock all hangers and serve a customer by lifting up the hanger with the clothing article of which the customer is interested, pulling the hanger out of the sleeve and hand over the article to the customer for trying it on.

In the same way, an attendant with access to stand and associate key may take care of the outer garments of visiting persons in the cloakroom of a public place. Also the personnel on a larger workingplace where there is risk of theft may be given own keys for stands according to the invention. For reason of simplicity, one lock may be provided in common for a group of hangers in a stand comprising several groups. Also an individual lock for each hanger can be imagined.

FIG. 1 shows a hanger according to the invention.

FIG. 2 shows a thiefproof ready-made clothes stand to be placed on the floor with hangers and holders and a suspended clothing article.

FIGS. 3–6 show examples of a possible locking device for a stand in different positions and sections.

FIGS. 7 and 8 show hangers with theft-prevention projections.

In FIGS. 1, 7 and 8, the horizontal portion of a hanger is designated by 12, and the downwardly directed portion by 1, which latter is provided with a recess 3 to be engaged by a latch-bolt. 11 and 12 are examples of different embodiments of projections to prevent a suspended clothing article being drawn off from the hanger. In FIG. 2, a tubular support 4 includes holders 5 and a lock 6, which actuates a latch-bolt 7. FIG. 3 is a section through said tubular support 4 from above, with the mechanism is locked position, and FIG. 4 shows the same view with the mechanism in unlocked position. When the recesses 9 in the latch-bolt 7 according to FIG. 4 coincide with the holders 5, a hanger can unobstructedly be inserted into or pulled out of the holders, but in locked position according to FIG. 3 the latch-bolt is moved into the recesses 3. FIG. 5 is a cross-section of the tubular support, but without locking mechanism. The holder 5 comprises a tube with a recess 8 for the passage of the latch-bolt. FIG. 6 shows the same view, with the latch-bolt inserted and in locked position, thereby engaging with the recess 3 in the hanger 1. The projection 7 to the left in FIGS. 3 and 4 is a signal showing whether or not the stand is locked.

What I claim is:

1. A clothes stand for supporting clothing articles having a sleeve, comprising a holder having a horizontal hollow portion with an upper wall, said upper wall having an aperture therein, a latch bolt slidably mounted in said hollow portion below said aperture, a hanger for supporting the clothing article having an upper arcuate horizontal portion, said upper arcuate horizontal portion terminating at one end in a downwardly extending vertical leg having a length approximately equal to the length of the sleeve of the supported article of clothing, the upper arcuate horizontal portion having a projecting member intermediate its ends enlarging the dimension of said upper portion such that it is larger than the internal dimension of the sleeve to prevent passage of the sleeve thereover, the lower end of said leg being received in said aperture in said upper wall and having a reduced portion received in said hollow portion and engagable with said latch bolt, the latch bolt being so arranged that in at least one position it permits insertion of said leg into said hollow portion and said reduced portion of said leg being engaged by the latch bolt in a second position of said latch bolt to prevent removal of said leg from said holder.

2. A clothes stand according to claim 1 wherein said upper wall has a series of apertures therein, said latch bolt has a series of recessed portions alignable with said apertures respectively and a plurality of said hangers having said vertical legs, the lower end of each leg being received in one of said apertures, the recessed portions of the latch bolt permitting insertion of said legs into said hollow portion and the reduced portion of each leg being engaged by the latch bolt to prevent removal of said legs from said holder.

3. A clothes stand according to claim 1 including lock means for locking said latch bolt.

4. A clothes stand according to claim 2 including lock means for locking said latch bolt.

* * * * *